US011280155B2

(12) United States Patent
Quero et al.

(10) Patent No.: US 11,280,155 B2
(45) Date of Patent: Mar. 22, 2022

(54) SINGLE TRIP WELLBORE CLEANING AND SEALING SYSTEM AND METHOD

(71) Applicant: Halliburton Energy Services, Inc., Houston, TX (US)

(72) Inventors: Philippe Quero, Houston, TX (US); Eric Bivens, Jr., Littleton, CO (US)

(73) Assignee: Halliburton Energy Services, Inc., Houston, TX (US)

( * ) Notice: Subject to any disclaimer, the term of this patent is extended or adjusted under 35 U.S.C. 154(b) by 107 days.

(21) Appl. No.: 16/637,065

(22) PCT Filed: Mar. 13, 2019

(86) PCT No.: PCT/US2019/022142

§ 371 (c)(1),
(2) Date: Feb. 6, 2020

(87) PCT Pub. No.: WO2020/185229

PCT Pub. Date: Sep. 17, 2020

(65) Prior Publication Data

US 2021/0230964 A1 Jul. 29, 2021

(51) Int. Cl.

| | |
|---|---|
| ***E21B 33/13*** | (2006.01) |
| ***E21B 29/00*** | (2006.01) |
| ***E21B 37/00*** | (2006.01) |
| ***E21B 43/11*** | (2006.01) |

(52) U.S. Cl.
CPC ..... *E21B 33/13* (2013.01); *E21B 29/00* (2013.01); *E21B 37/00* (2013.01); *E21B 43/11* (2013.01)

(58) Field of Classification Search
CPC ..... E21B 33/13; E21B 37/00; E21B 29/00; E21B 43/11
See application file for complete search history.

(56) References Cited

U.S. PATENT DOCUMENTS 2,054,353 A * 9/1936 Yowell ..... E21B 33/12 166/254.1
3,393,736 A * 7/1968 Goodwin ..... E21B 43/114 166/276
3,720,264 A * 3/1973 Hutchison ..... E21B 41/0078 166/311
5,577,560 A * 11/1996 Coronado ..... E21B 17/003 166/387
9,334,712 B2 * 5/2016 Bakken ..... E21B 33/134
(Continued)

FOREIGN PATENT DOCUMENTS

WO 2018224819 12/2018

OTHER PUBLICATIONS

Hydrawell, "HydraHemera Product Report", 2017, 1 page.
(Continued)

*Primary Examiner* — Steven A Macdonald
(74) *Attorney, Agent, or Firm* — Kilpatrick Townsend & Stockton LLP

(57) ABSTRACT

A method includes deploying a downhole tool within a wellbore. While the downhole tool is within the wellbore, the method also includes slotting or perforating a casing of the wellbore at the target interval to expose formation surrounding the wellbore. Further, the method includes flushing the target interval to remove wellbore debris from the target interval. Furthermore, the method includes pacing a cement or sealant plug at the target interval.

20 Claims, 13 Drawing Sheets

(56) References Cited

U.S. PATENT DOCUMENTS

| | | | | |
|---|---|---|---|---|
| 9,970,257 | B2 * | 5/2018 | Bakken | E21B 43/11 |
| 2005/0061508 | A1 * | 3/2005 | Surjaatmadja | E21B 43/26 166/306 |
| 2009/0145601 | A1 * | 6/2009 | Bailey | E21B 17/028 166/250.04 |
| 2012/0125619 | A1 * | 5/2012 | Wood | E21B 43/267 166/308.1 |
| 2013/0312963 | A1 * | 11/2013 | Larsen | E21B 41/00 166/285 |
| 2014/0138078 | A1 * | 5/2014 | Lerbrekk | E21B 43/116 166/55 |
| 2014/0238675 | A1 * | 8/2014 | Hallundb | E21B 33/134 166/285 |
| 2015/0034317 | A1 * | 2/2015 | Skjold | E21B 33/1204 166/288 |
| 2015/0053405 | A1 * | 2/2015 | Bakken | E21B 33/14 166/285 |
| 2015/0107858 | A1 * | 4/2015 | Prebensen | C09K 8/502 166/386 |
| 2016/0194934 | A1 * | 7/2016 | Bakken | E21B 37/08 166/285 |
| 2017/0067313 | A1 * | 3/2017 | Connell | E21B 37/00 |
| 2018/0187518 | A1 * | 7/2018 | Myhre | E21B 37/08 |
| 2020/0173249 | A1 * | 6/2020 | Fairweather | E21B 43/116 |
| 2021/0079748 | A1 * | 3/2021 | Wardley | E21B 33/138 |

OTHER PUBLICATIONS

International Application No. PCT/US2019/022142, International Search Report and Written Opinion, dated Dec. 12, 2019, 14 pages.

* cited by examiner

SINGLE TRIP WELLBORE CLEANING AND SEALING SYSTEM AND METHOD

TECHNICAL FIELD

The present disclosure relates generally to a system and method for cleaning and sealing a wellbore. More specifically, though not exclusively, the present disclosure relates to systems and methods that prepare a wellbore for sealing in a single trip within the wellbore, perform slot recovery in a single hip within the wellbore, or repair damaged sections of the wellbore in a single trip within the wellbore.

BACKGROUND

During wellbore abandonment operations, a wellbore seal is positioned within the wellbore to avoid unwanted fluid communication between a formation surrounding the wellbore and a surface of the wellbore. To abandon the wellbore, a multi-step abandonment process may be executed. For example, the wellbore may be cleaned near a desired location of the wellbore seal. Additionally, casing may be perforated to provide sealing communication between the wellbore and the formation. Further, the desired location may be conditioned for sealing and the sealing material may be installed to seal the wellbore for abandonment.

In operation, each of these steps of the multi-step abandonment process is implemented with a different run into the wellbore. For example, each of the steps may involve a different tool placed at the end of a jointed pipe and a different process associated with the individual step. Between the steps, the tool may be removed from the wellbore and replaced with a tool associated with a subsequent step of the abandonment process. The cycle of inserting and removing tools into and from the wellbore may be repeated multiple times until the abandonment process is completed. Additionally, some abandonment techniques may involve leaving or otherwise abandoning tool components downhole within the wellbore, and some of the abandonment techniques may require the use of jointed pipe for deployment of the tools.

DETAILED DESCRIPTION

Certain aspects and examples of the disclosure relate to systems and methods for preparing an oil and gas wellbore for abandonment or remediation. More specifically, though not exclusively, the present disclosure relates to systems and methods that prepare the wellbore for sealing or remediation in a single trip within the wellbore. That is, the systems and methods prepare the wellbore for installation of a cement plug within the wellbore in a manner that prevents unwanted communication between fluids within the wellbore or the formation and a surface of the wellbore. A single trip or run into the wellbore may refer to a downhole tool performing multiple operations within the wellbore without being removed from the wellbore between individual operations. In some examples, the downhole tool may clean blockages from a path within the wellbore, perform perforations on casing within the wellbore, clean debris from the perforations, and install the cement plug all in a single trip within the wellbore.

A downhole tool according to some examples may include several tools or subs operating as a bottom hole assembly. Each of the tools or subs of the downhole tool may perform an operation associated with sealing a wellbore. For example, a cleaning tool may clean the wellbore during a run-in operation to remove debris from a target interval for installation of a cement plug. A perforating tool may perforate or slot casing within the wellbore to provide sealing communication between the cement plug and a formation surrounding the wellbore. Further, an additional cleaning tool may clean perforating debris from the target interval, and a cementing tool may provide material for a quick setting chemical plug and the cement for the cement plug to the target interval within the wellbore. A lower barrier for placing of cement across the target interval may be a quick setting chemical plug, a mechanical plug or packer, or an inflatable plug or packer. These operations may be performed by a single bottom hole assembly on a single run into the wellbore. Further, the downhole tool may be delivered downhole within the wellbore using coiled tubing, which may enable installation of the cement plug within a live well.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

Figure 1:
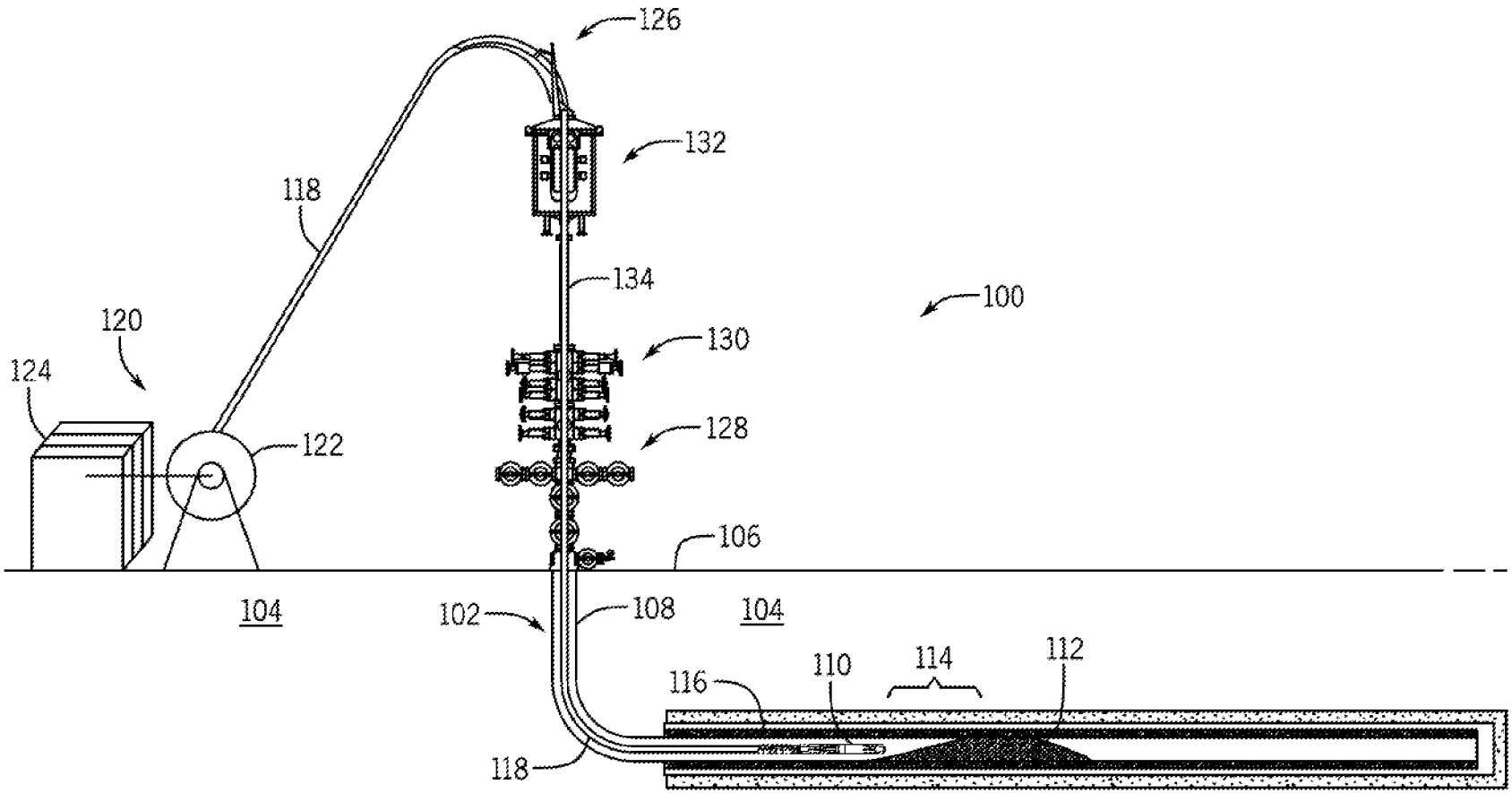
FIG. 1 is a cross-sectional schematic view of an example of a wellbore environment according to some aspects of the present disclosure.

FIG. 1 is a cross-sectional schematic view of an example of a wellbore environment 100. When a well 102 is damaged or otherwise unusable, operations may be performed on the well 102 to either remediate the damage or to abandon the well 102. Remediating the well may involve installing cement within the wellbore to repair a damaged section of casing. The added layer of cement may maintain integrity of the damaged casing during future operations. Further, when an oil and gas well is no longer in use, an abandonment operation may be performed. Abandonment may involve ending unwanted communication between a formation 104 surrounding the well 102 and a surface 106 of the well 102. To end this communication between the formation 104 and the surface 106, a cement plug in sealing communication with the formation 104 may be installed within a wellbore 108 of the well 102.

A downhole tool 110 (e.g., a bottom hole assembly) may be used to prepare the wellbore 108 for installation of the cement plug and also for the installation of the cement plug within the wellbore 108. For example, the downhole tool 110 may include multiple tools or subs capable of performing varying operations for installation of the cement plug within the wellbore 108. In an example, the downhole tool 110 may be capable of cleaning debris 112 from the wellbore 108 when the downhole tool 110 is run into the wellbore 108. Once the downhole tool 110 reaches a target interval 114 of the wellbore 108, the downhole tool 110 may perform a perforating or slotting operation through a casing 116 to create a path for the cement plug to achieve sealing communication with the formation 104. In an example, the target interval 114 may be a location at which the cementing plug is installed. In another example, the target interval may be a location where the casing 116 has been damaged.

After perforating or slotting the casing 116, the downhole tool 110 may clean perforation debris away from the perforations or slots in the casing 116 using a fluid oscillator tool of the downhole tool 110. Cleaning the debris from the perforations or slots in the casing 116 may prepare the target interval 114 for the cementing process associated with installing the cement plug. In an example, the fluid oscillator tool may jet water, brine, spotting acid, solvent, or other cleaning agents at the target interval 114 to remove any perforating debris or material buildup away from the target interval 114. By removing the debris and buildup from the target interval 114, sealing communication between the cement plug and the formation 104 may be improved.

Once the target interval 114 is prepared for installation of the cement plug, a large flow port of the downhole tool 110 may be activated. The large flow port of the downhole tool 110 may enable transmission of fluid used for a chemical plug to a location at a downhole area of the target interval 114. When the chemical plug is set, the large flow port of the downhole tool 110 may begin layering or otherwise placing the cement for the cement plug at the target interval 114. While the cement plug is described herein as being made of cement, a sealant plug or plug made from a sealant combined with cement may also be used. In an example, the sealant may be a hardening resin capable creating sealing communication with the formation 104 surrounding the wellbore 108.

As illustrated, the downhole tool 110 is coupled to an end of coiled tubing 118. The coiled tubing 118 may be deployed with the downhole tool 110 into the wellbore 108 using a coiled tubing system 120. In an example, the coiled tubing system 120 may include a reel 122 that stores unused coiled tubing 118 and turns to inject or retract the coiled tubing 118 within the wellbore 108. The coiled tubing system 120 may also include multiple fluid storage tanks 124. The fluid storage tanks 124 may store fluid provided by the coiled tubing system 120 to the downhole tool 110 to clean the wellbore 108, to perforate or slot the casing 116, to clean debris and buildup from the slotted or perforated areas of the casing 116, to install a chemical plug, to install a cement plug, or any combination thereof.

When deploying the downhole tool 110 into the wellbore 108 using the coiled tubing system 120, the coiled tubing may be run through a gooseneck 126. The gooseneck 126 may guide the coiled tubing 118 as it passes from a reel orientation in the reel 122 to a vertical orientation within the wellbore 108. In an example, the gooseneck 126 may be positioned over a wellhead 128 and a blowout preventer 130 using a crane (not shown).

The gooseneck 126 may be attached to an injector 132, and the injector 132 may be attached to a lubricator 134, which is positioned between the injector 132 and the blowout preventer 130. In operation, the injector 132 grips the coiled tubing 118 and a hydraulic drive system of the injector 132 provides an injection force on the coiled tubing 118 to drive the coiled tubing 118 within the wellbore 108. The lubricator 134 may provide an area for staging tools (e.g., the downhole tool 110) prior to running the tools downhole within the wellbore 108 when the wellbore 108 represents a high-pressure well. Further, the lubricator 134 provides an area to store the tools during removal of the tools from the high-pressure well. That is, the lubricator 134 provides a staging area for injection and removal of tools into and from a high-pressure well (e.g., a live well).

While the wellbore environment 100 is depicted as using the coiled tubing 118 to install the downhole tool 110 within the wellbore 108, other tool conveyance systems may also be employed. For example, the wellbore environment 100 may include a jointed pipe system to install the downhole tool 110 within the wellbore 108. Additionally, while the wellbore environment 100 is depicted as a land based environment, the downhole tool 110 may also be similarly introduced and operated in a subsea based environment.

Figure 2:
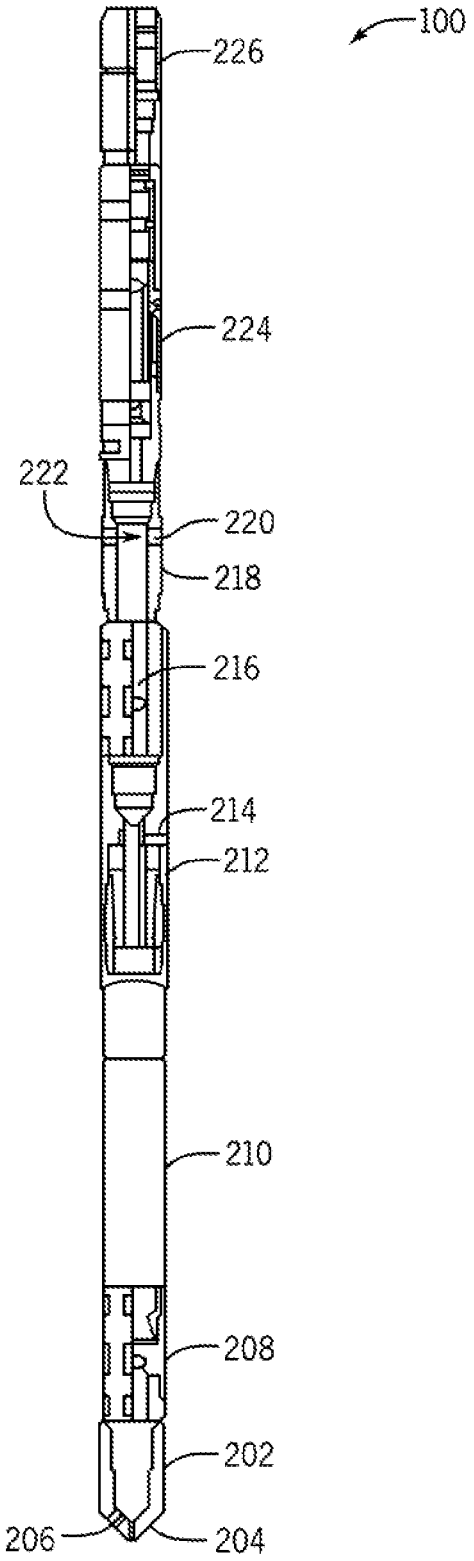
FIG. 2 is a schematic view of an example downhole tool used in the wellbore environment of FIG. 1 according to some aspects of the present disclosure.

FIG. 2 is a schematic view of an example of the downhole tool 110 used to create a cement plug within the wellbore 108 for abandonment of the well 102 or to remediate any damage to the casing 116 within the wellbore 108. At a downhole end of the downhole tool 110, a tapered bull nose 202 may be installed. The tapered bull nose 202 may enable the downhole tool 110 to bypass inner-diameter variations within the wellbore 108. For example, a tapered end 204 may prevent the downhole tool 110 from hanging up on uneven surfaces within the wellbore 108 while the downhole tool 110 is run to the target interval 114 within the wellbore 108. Further, the tapered bull nose 202 may include one or more fluid jets 206. The fluid jets 206 may jet fluid into the wellbore 108 to remove the debris 112 from the target interval 114 or from other portions of the wellbore 108 when the downhole tool 110 is run into the wellbore 108.

A ball seat 208 may be positioned along the downhole tool 110 uphole from the tapered bull nose 202. When the target interval 114 is reached, a ball may be dropped into the downhole tool 110 and lodged in the ball seat 208 to prevent a flow of fluid into the tapered bull nose 202. By preventing the flow of fluid to the tapered bull nose 202, the fluid may be diverted to other tools positioned uphole from the ball seat 208.

For example, a perforating or slotting tool 210 may be positioned uphole from the ball seat 208. When a ball is dropped to lodge in the ball seat 208, the fluid provided to the downhole tool 110 may be changed from water, brine, or cleaning fluid to an abrasive slurry designed to perforate or slot the casing 116 within the wellbore 108. The abrasive slurry may be a fluid with a significant concentration of abrasive material (e.g., sand, garnet, or other particulate media). In another example, the abrasive slurry may include temporary materials such as plasticized poly-lactic acid (PLA), dissolvable metallic powder, degradable particles, or water or acid soluble materials (e.g., calcium borate, calcium carbonate, rock salt, etc.). A soluble or degradable medium used in the abrasive slurry may limit residual material left behind after the perforations are completed. The residual material that accompanies a non-soluble or non-degradable material may rely on additional fluids to circulate the residual material clear of the wellbore 108, or a later cleanout operation. Any remnants of the soluble or degradable medium may degrade or dissolve in place either through active placement of a dissolution or breakdown agent or based on exposure time to the downhole environment.

The abrasive slurry is pumped through the perforating or slotting tool 210 through at least one hydraulic jet toward the casing 116 at a high flow rate to generate perforations or slots within the casing 116. The perforations or slots eventually enable a sealing communication between the cement plug and the formation 104. Other examples of the slotting tool 210 may include explosive, mechanical, or chemical methods to create the perforations or slots.

After a perforating or slotting operation is completed by the perforating or slotting tool 210, an additional ball may drop into a fluidic oscillator 212 (e.g., a wash tool). Prior to the ball dropping, the fluidic oscillator 212 may maintain an inner diameter bypass for fluid to flow to the tools positioned downhole from the fluidic oscillator 212 along the downhole tool 110. When the ball drops into the fluidic oscillator 212, an internal sleeve within the fluidic oscillator 212 may shift to open oscillating side ports 214 that provide oscillating fluid to clean the target interval 114. Additionally, the ball dropped into the fluidic oscillator 212 may block the inner diameter bypass such that fluid is forced out of the oscillating side ports 214.

An additional ball seat 216 may be positioned uphole from the fluidic oscillator 212. When a cleaning operation is completed by the fluidic oscillator 212, a ball may be dropped into the downhole tool 110 and lodged in the ball seat 216 to prevent a flow of fluid into the fluidic oscillator 212. By preventing the flow of fluid to the fluidic oscillator 212, the fluid may be diverted to other tools positioned uphole from the ball seat 216.

For example, the downhole tool 110 may include a burst disc tool 218 positioned uphole from the ball seat 216. The burst disc tool 218 may include a disc 220 that is designed to burst when a pressure within a chamber 222 exceeds a pressure threshold of the disc 220. The pressure threshold may be sufficiently high such that operations performed by other sections of the downhole tool 110 do not prematurely burst the disc 220. Because the ball dropped into the ball seat 216 blocks a fluid path to fluid outlets associated with other sections of the downhole tool 110, the pressure in the chamber 222 builds until the pressure threshold is reached and the disc 220 bursts. The burst disc 220 generates a port through which fluid to install a chemical plug, cement to install a cement plug, and any other fluid may flow to complete the cement plug installation process.

A motorhead assembly (MHA) 224 may be positioned uphole from the burst disc tool 218. The MHA 224 may include a check valve, a hydraulic disconnect, and a circulating sub. The check valve may prevent backflow of fluid within the downhole tool 110 toward the coiled tubing 118. Additionally, the hydraulic disconnect may provide a mechanism capable of quickly disconnecting the MHA 224 from a remainder of the downhole tool 110. Further, the circulating sub may enable an increase in a circulation rate of fluid toward the surface 106 of the well 102. The increase in the circulation rate may enable greater circulating fluid flow toward the surface 106 of the wellbore 108 to transport of the debris 112 within the wellbore 108 to the surface 106.

The downhole tool 110 may also include a connector 226 positioned at an uphole end of the downhole tool 110. The connector 226 may connect the downhole tool 110 with a work string (e.g., the coiled tubing 118, jointed pipe, etc.). Further, the connector 226 may be any type of connector to suit a particular work string of the wellbore environment 100.

Figures 3A, 3B:
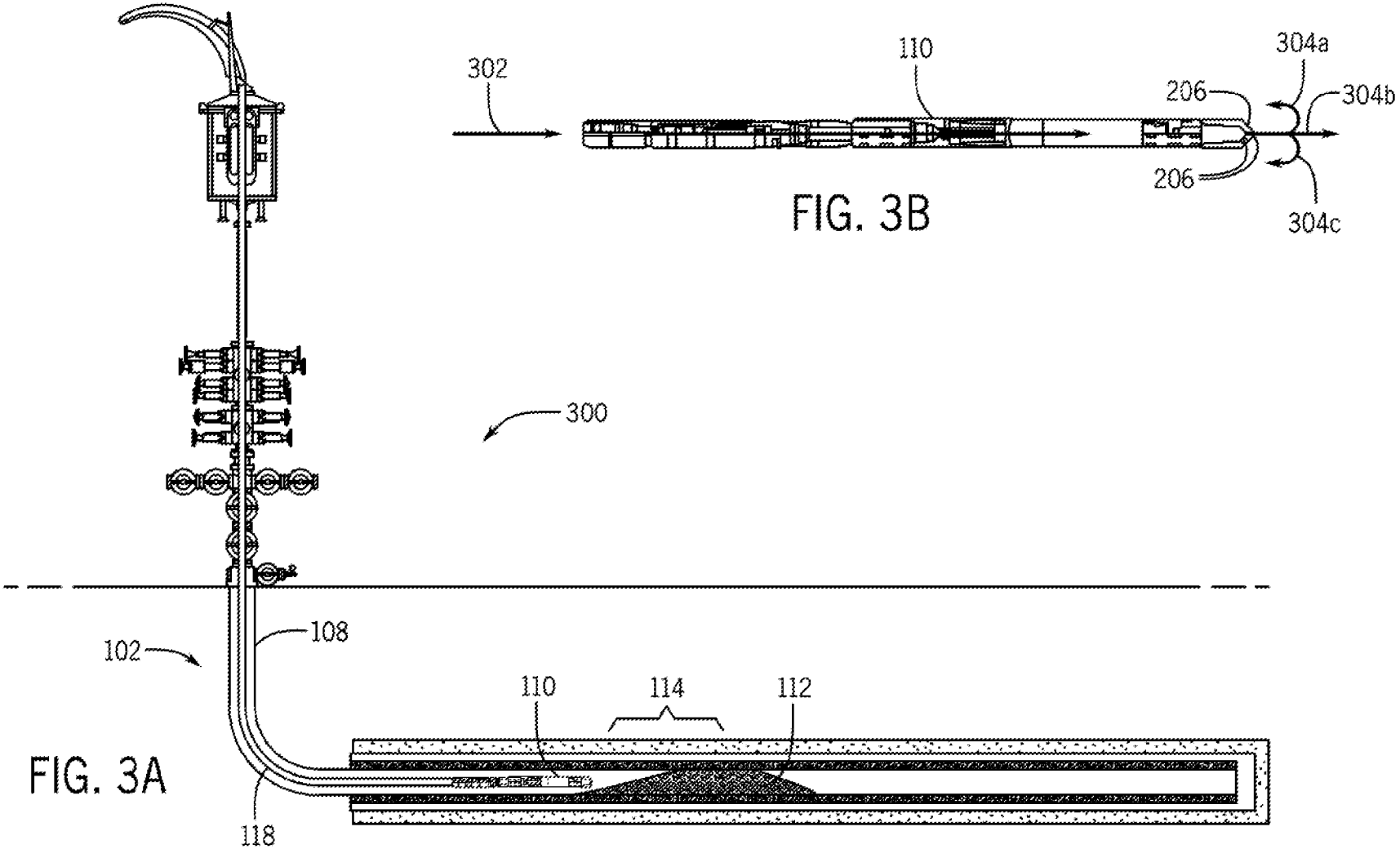
FIG. 3A is a cross-sectional view of the wellbore environment of FIG. 1 during a cleaning stage according to some aspects of the present disclosure.
FIG. 3B is a cross-sectional view of the downhole tool of FIG. 2 during the cleaning stage of FIG. 3A according to some aspects of the present disclosure.

FIG. 3A is a cross-sectional view of a wellbore environment 300 during a cleaning stage. As the downhole tool 110 is run into the wellbore 108, the downhole tool 110 may jet fluid into the wellbore 108 to clean through any blockages (e.g., the debris 112) on the way to the target interval 114 where the cement plug will be installed or where wellbore remediation is desired. The fluid may be jetted using forward circulation through the coiled tubing 118 and the downhole tool 110. Additionally, in an example with a large diameter of the wellbore 108 or wells 102 with insufficient lift pressure, the downhole tool 110 may clean the blockages in the wellbore 108 using reverse circulation if the check valve of the MHA 224 is removed.

FIG. 3B is a cross-sectional view of the downhole tool 110 during the cleaning stage. As illustrated, cleaning fluid (e.g., water, brine, cleaning solvent, etc.) may enter the downhole tool 110 flowing in a direction 302. The cleaning fluid may flow continuously through the downhole tool 110 until it reaches the fluid jets 206 (i.e., outlet nozzles). In an example, the fluid jets 206 may be positioned on the tapered bull nose 202. In other example, the fluid jets 206 may be part of a wash nozzle, an additional fluidic oscillator, or any other tool positioned along the downhole tool 110. The cleaning fluid may exit the fluid jets 206 in directions 304*a*, 304*b*, and 304*c* toward any blockages within the wellbore 108 while the downhole tool 110 is run into the wellbore 108.

Figures 4A, 4B:
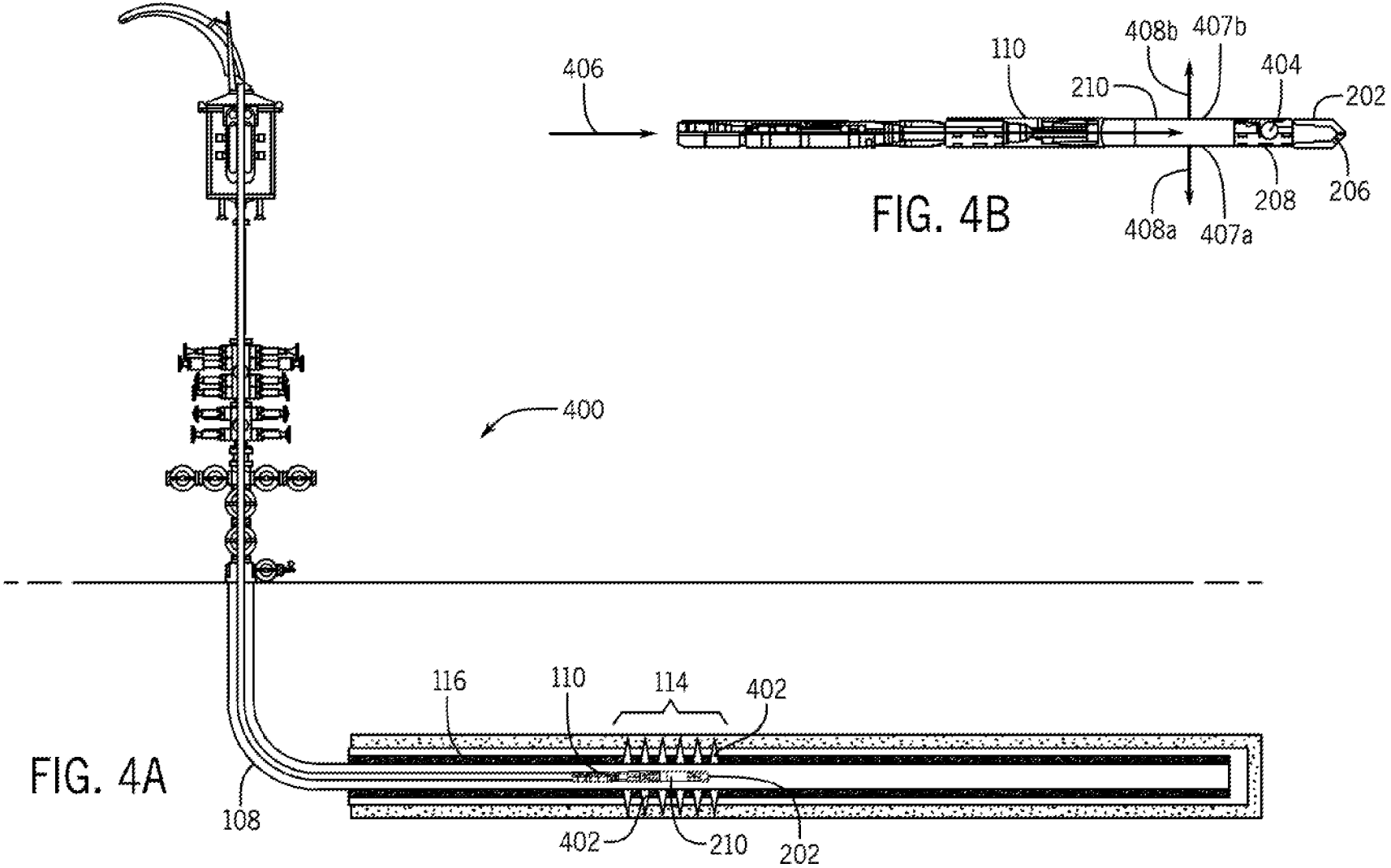
FIG. 4A is a cross-sectional view of the wellbore environment of FIG. 1 during a perforating stage according to some aspects of the present disclosure.
FIG. 4B is a cross-sectional view of the downhole tool of FIG. 2 during the perforating stage of FIG. 4A according to some aspects of the present disclosure.

FIG. 4A is a cross-sectional view of a wellbore environment 400 during a perforating stage. When the downhole tool 110 arrives at the target interval 114, a ball may be dropped into the downhole tool 110 and lodged in the ball seat 208 to prevent a flow of fluid into the tapered bull nose 202. By preventing the flow of fluid to the tapered bull nose 202, the fluid may be diverted to the perforating or slotting tool 210.

Abrasive slurry may be provided to the perforating or slotting tool 210 at a target cut rate. That is, the abrasive slurry may be provided to the perforating or slotting tool 210 with a pressure sufficient to reach the target cut rate capable of cutting through the casing 116 to produce perforations 402 in the casing 116. When the perforations 402 are desired, the perforating or slotting tool 210 may be maintained in a stationary position until the perforations 402 of an adequate size are generated. Further, the downhole tool 110 may be moved uphole or downhole within the wellbore 108 to generate another layer of perforations 402 in the casing 116. When slots are desired that remove sections of the casing 116, the downhole tool 110 may be moved or rotated, as desired, to generate the slots in the casing 116.

FIG. 4B is a cross-sectional view of the downhole tool 110 during the perforating stage. As illustrated, a ball 404 is lodged in the ball seat 208. The ball 404 lodged in the ball seat 208 prevents fluid from traveling to the tapered bull nose 202 for ejection at the fluid jets 206. Accordingly, the abrasive slurry traveling in a direction 406 into the downhole tool 110 may be forced to exit the downhole tool 110 hydraulic jets 407*a* and 407*b* at the perforating or slotting tool 210 in directions 408*a* and 408*b* toward the casing 116. Exiting the perforating or slotting tool 210 in such a manner may result in generation of the perforations 402 or slots in the casing 116.

While the perforating or slotting tool 210 is depicted as an abrasive tool, other perforating or slotting tools 210 may also be used. For example, the perforating or slotting tool 210 may be an alternative mechanical or chemical cutting tool. The alternative mechanical cutting tool may include an expandable blade or a tubing punch capable of cutting or punching through the casing 116. The chemical cutting tool may include any type of chemical or thermal cutter. Further, the perforating or slotting tool 210 may also be an expandable underreamer to remove an entire section of the casing 116. In another example, the perforating or slotting tool 210 may be an explosive perforating tool (e.g., a perforating gun).

Figures 5A, 5B:
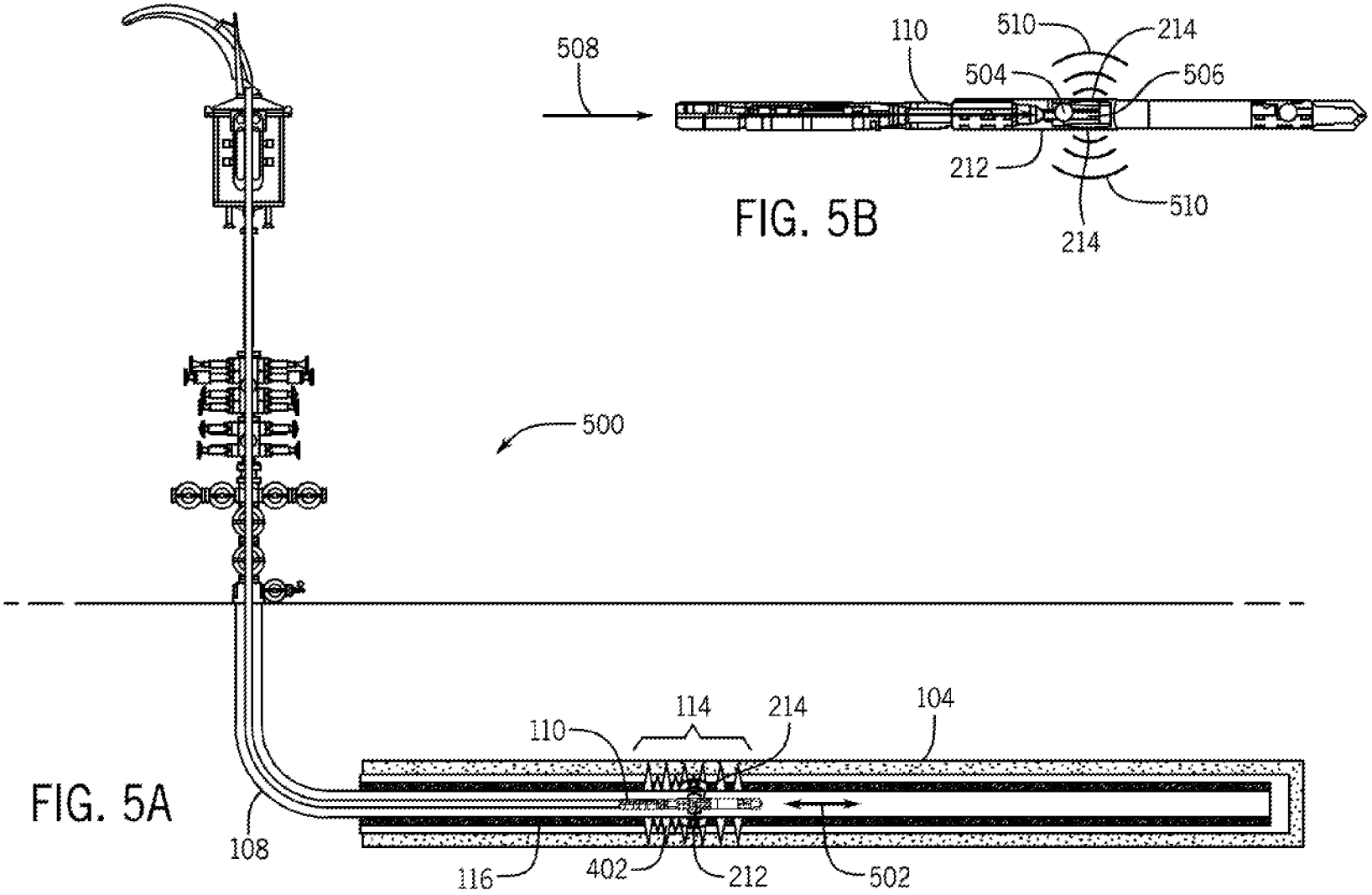
FIG. 5A is a cross-sectional view of the wellbore environment of FIG. 1 during a flushing stage according to some aspects of the present disclosure.
FIG. 5B is a cross-sectional view of the downhole tool of FIG. 2 during the flushing stage of FIG. 5A according to some aspects of the present disclosure.

FIG. 5A is a cross-sectional view of the wellbore environment 500 during a flushing stage. After the perforating or slotting operation is completed by the perforating or slotting tool 210, an additional ball may drop into a fluidic oscillator 212. When the ball drops into the fluidic oscillator 212, a flow of fluid may be diverted to the oscillating side ports 214 of the fluidic oscillator 212. The oscillating side ports 214 transmit fluid into the wellbore 108 in an oscillating manner to provide a thorough flush of the perforations 402 or slots cut through the casing 116. Further, the downhole tool 110 may be moved uphole and downhole in several passes, as indicated by arrow 502, within the wellbore 108 to flush an entirety of the target interval 114.

FIG. 5B is a cross-sectional view of the downhole tool 110 during the flushing stage. Prior to a ball 504 dropping, the fluidic oscillator 212 may maintain an inner diameter bypass 506 for fluid to flow to the tools positioned downhole from the fluidic oscillator 212. When the ball 504 drops into the fluidic oscillator 212, an internal sleeve within the fluidic oscillator 212 may shift to open oscillating side ports 214 that transmit oscillating fluid into the wellbore 108 to clean the target interval 114. The fluid may flow in a direction 508 into the downhole tool and flow through the oscillating side ports 214, as depicted by oscillating waves 510. The fluid that flows through the oscillating side ports 214 may include a spotting acid, a solvent, or another cleaning agent to remove buildup, scale, or any other debris from within the wellbore 108 or from the formation 104. Further, the fluid flowing through the oscillating side ports 214 may place a conditioning treatment within the perforations or slots to prepare the target interval 114 for subsequent material placement (e.g., installation of the chemical plug or the cement plug).

The fluidic oscillator 212 may provide the fluid with pulsating resonance as a cyclic output. This cyclic output may help break up any consolidated fill within the perforations 402 or the slots, and the pulse and flow aspect of the cyclic output may also provide an ability to flush any fill from irregular channels or profiles of the perforations 402 or the slots. Further, when the fluidic oscillator 212 is operated where a hydrostatic load is present, the cyclic output may also create a localized Coriolis force around the downhole tool 110. This may ensure a full coverage flush across the target interval 114. While the fluidic oscillator 212 is depicted, other cleaning tools capable of cleaning or otherwise pre-treating the target interval 114 may also be used.

Figures 6A, 6B:
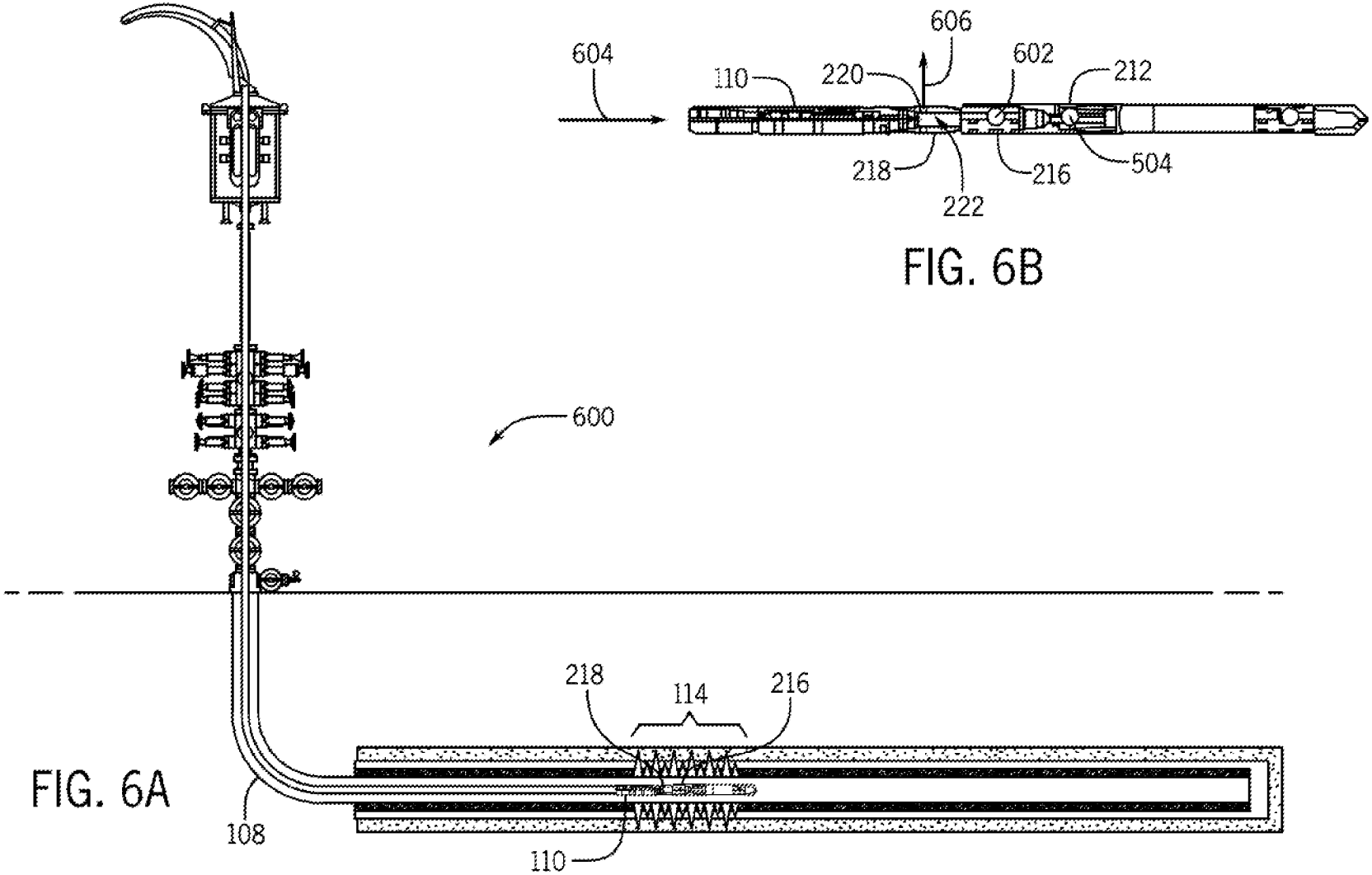
FIG. 6A is a cross-sectional view of the wellbore environment of FIG. 1 during a bypass port transition stage according to some aspects of the present disclosure.
FIG. 6B is a cross-sectional view of the downhole tool of FIG. 2 during the bypass port transition stage of FIG. 6A according to some aspects of the present disclosure.

FIG. 6A is a cross-sectional view of the wellbore environment 600 during a bypass port transition stage. The additional ball seat 216 may be positioned uphole from the fluidic oscillator 212. When the flushing operation is completed by the fluidic oscillator 212, a ball may be dropped into the downhole tool 110 and lodged in the ball seat 216 to prevent a flow of fluid into the fluidic oscillator 212. By preventing the flow of fluid to the fluidic oscillator 212, the fluid may be diverted to the burst disc tool 218. When fluid pressure at the burst disc tool 218 exceeds a pressure threshold of the disc 220, the disc 220 may burst generating a port through which fluid is able to exit the downhole tool 110 into the wellbore 108.

FIG. 6B is a cross-sectional view of the downhole tool 110 during the bypass port transition stage. A ball 602 may be dropped into the downhole tool 110 to lodge in the ball seat 216. As fluid enters the downhole tool 110 in a direction 604, pressure may build up in the chamber 222 of the burst disc tool 218. When the pressure within the chamber 222 exceeds a pressure threshold of the disc 220, the disc 220 may burst. The burst disc 220 generates a port through which fluid to install a chemical plug, cement to install a cement plug, and any other fluid may flow in a direction 606 to complete the cement plug installation process or a wellbore damage remediation process.

In other examples, the fluid used to install the chemical plug and the cement used to install the cement plug may be pumped through the fluidic oscillator 212 if the ball 602 is not dropped into the downhole tool 110. Further, in an example, a sleeve or the ball 504 of the fluidic oscillator 212 may pushed out of the downhole tool 110 when the sleeve or the ball 504 are seated on a secondary shear pin. This may enable the fluid used to install the chemical plug and the cement used to install the cement plug to be deposited within the wellbore 108 using other fluid ports downhole from the fluidic oscillator 212 in the downhole tool 110.

Figure 7:
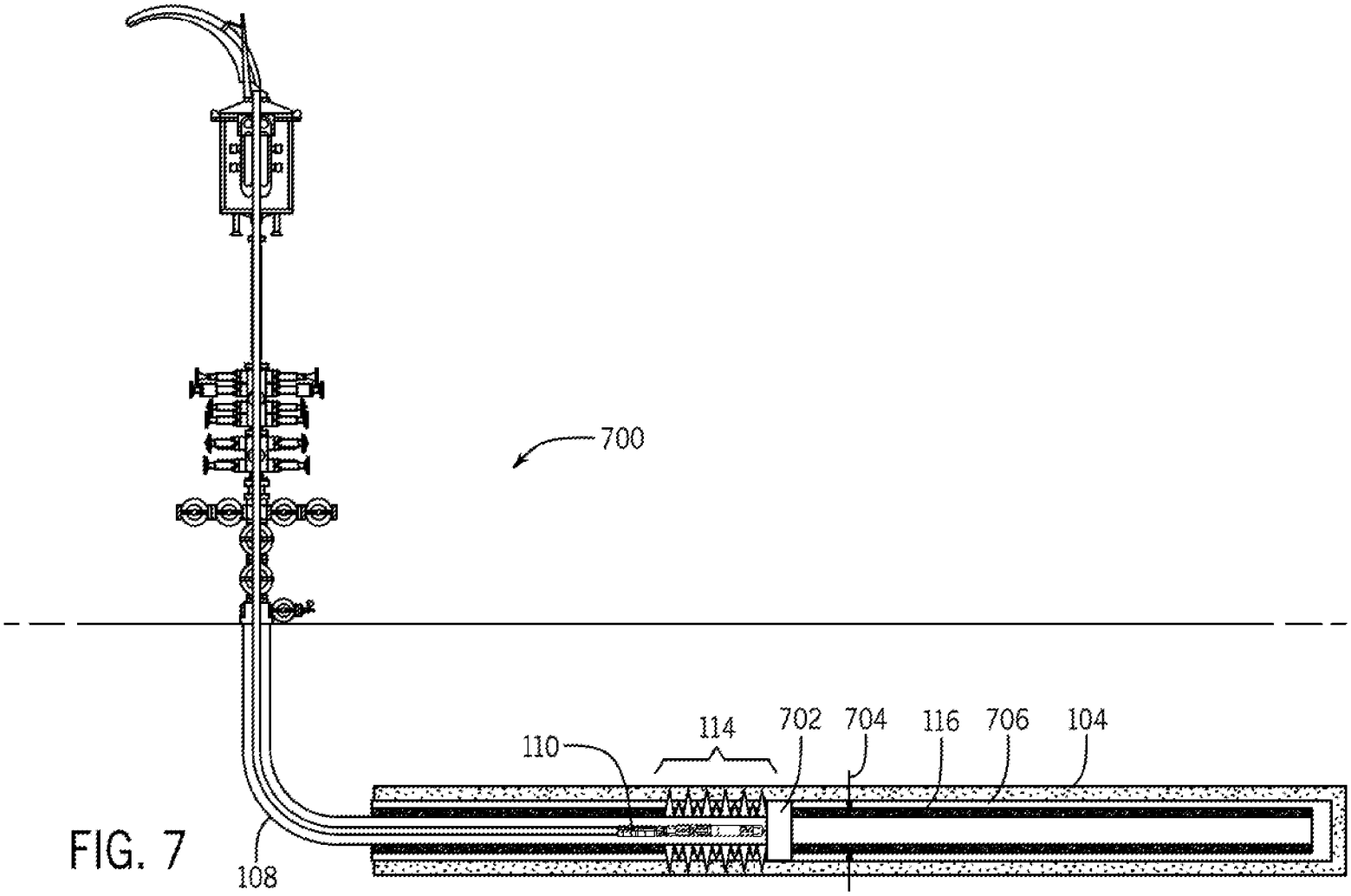
FIG. 7 is a cross-sectional view of the wellbore environment of FIG. 1 during an initial portion of a chemical plugging stage according to some aspects of the present disclosure.

FIG. 7 is a cross-sectional view of a wellbore environment 700 during an initial portion of a chemical plugging stage. When the disc 220 of the burst disc tool 218 bursts, a chemical plug 702 may be layered or otherwise placed into the wellbore 108 at a location downhole from the target interval 114 or at a downhole end of the target interval 114. Layering or otherwise placing the chemical plug 702 in the wellbore 108 may involve gradually depositing a fluid that forms the chemical plug at the location downhole from the target interval 114 while slowly withdrawing the downhole tool 110 toward the surface 106 of the wellbore 108. Layering or otherwise placing the chemical plug 702 provides an operator with the ability to control the placement of the chemical plug 702 within the wellbore 108. The chemical plug 702 may enable temporary downhole isolation of an inner diameter 704 of the casing 116 and an annulus 706 surrounding the casing 116 (e.g., a layer of cement between the casing 116 and the formation 104). As illustrated, the chemical plug 702 extends across a diameter of the wellbore 108 such that the chemical plug 702 is in contact with the formation 104 (i.e., the chemical plug 702 extends beyond the casing 116). In other examples, the chemical plug 702, or a different type of mechanical plug positionable within the wellbore 108, may extend across the inner diameter 704 such that the chemical plug 702 creates a barrier that is limited to a volume within the casing 116 (i.e., such that the chemical plug 702 is not in contact with the formation 104).

The chemical plug 702 may be made from a chemical capable of hardening in several hours, and the chemical plug 702 may maintain its integrity for multiple days. Further, the chemical plug 702 may degrade and liquefy after a set amount of exposure time, or the chemical plug 702 may be immediately dissolved upon contact with hydrochloric acid (HCl). In an example, the chemical plug 702 may provide a platform upon which a cement plug is installed. Other versions of the tool may use a mechanical or inflatable barrier in place of the chemical plug 702.

Figure 8:
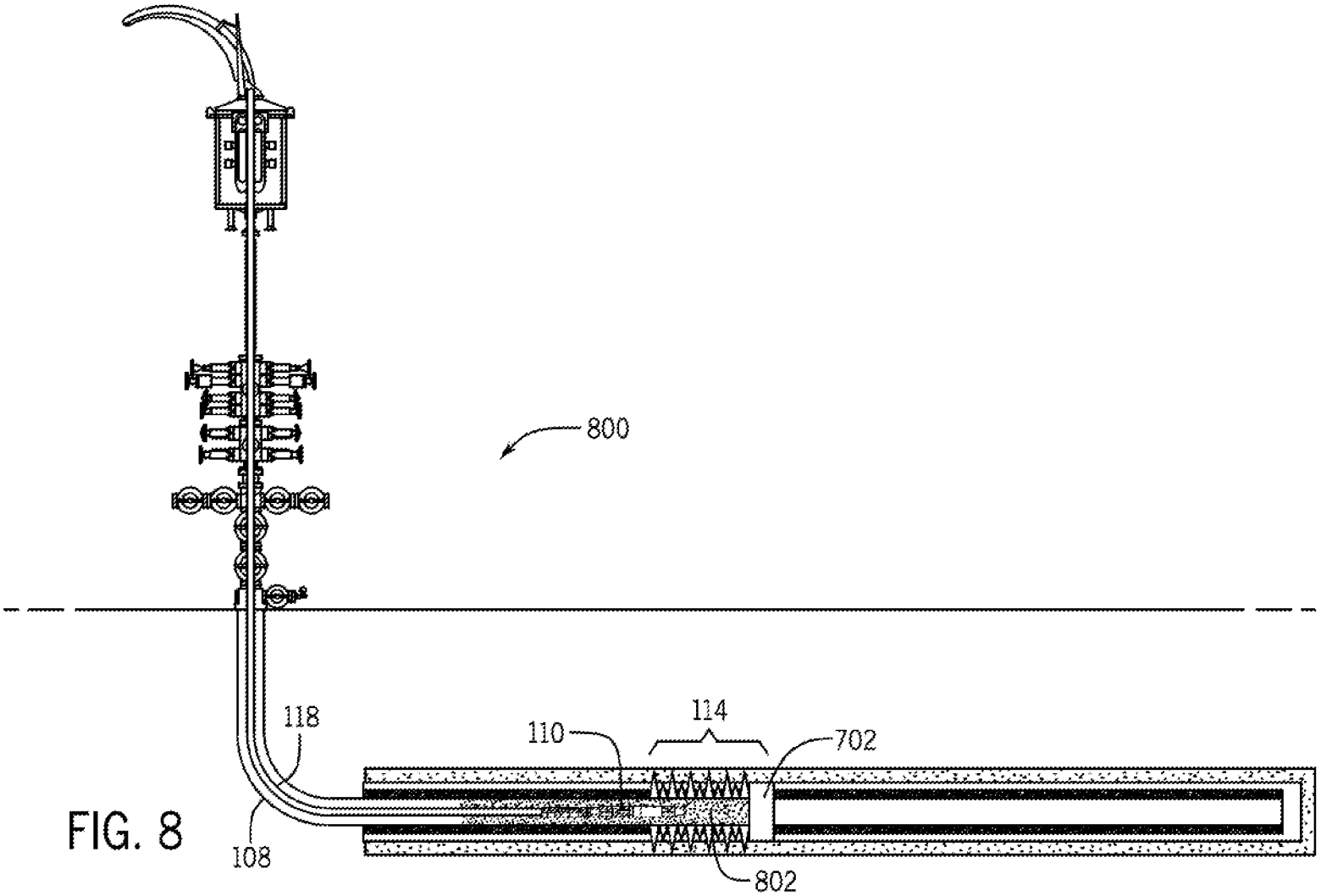
FIG. 8 is a cross-sectional view of the wellbore environment of FIG. 1 during a final portion of the chemical plugging stage according to some aspects of the present disclosure.

FIG. 8 is a cross-sectional view of a wellbore environment 800 during a final portion of the chemical plugging stage. When the chemical plug 702 is installed by the downhole tool 110, the downhole tool 110 may be moved uphole with the coiled tubing 118 within the wellbore 108. As the downhole tool 110 moves uphole, the downhole tool 110 may displace fluid within the wellbore 108 with a conditioning fluid 802. The conditioning fluid 802 may be compatible with cement of the cement plug, and the conditioning fluid 802 may replace fluid in the wellbore 108 that may not be compatible with the cement.

Figure 9:
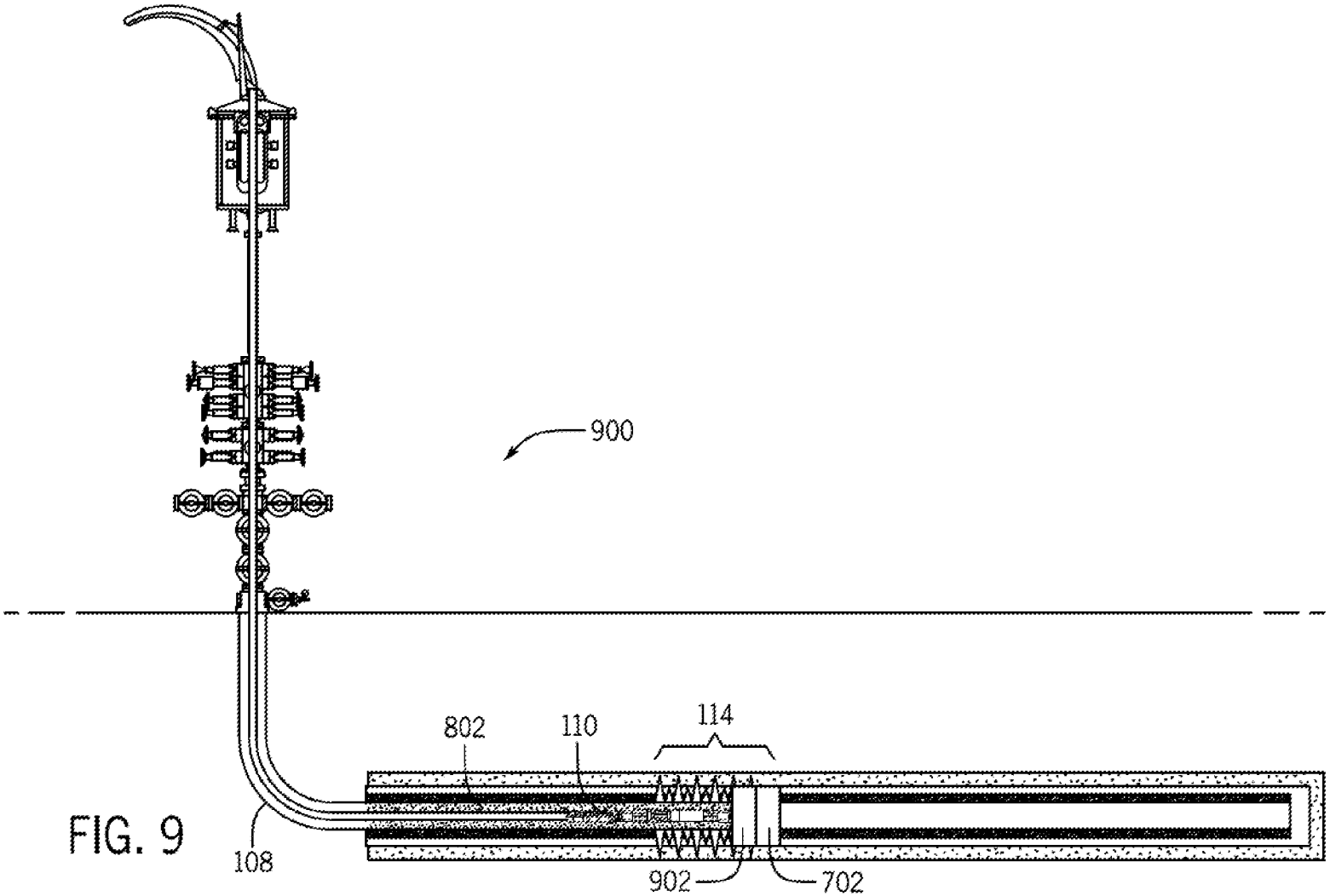
FIG. 9 is a cross-sectional view of the wellbore environment of FIG. 1 during an initial portion of a cement layering stage according to some aspects of the present disclosure.

FIG. 9 is a cross-sectional view of a wellbore environment 900 during an initial portion of a cement layering stage. After the conditioning fluid 802 displaces wellbore fluid near the chemical plug 702, the downhole tool 110 may be repositioned near the chemical plug 702 to commence a cementing operation. For example, cement 902 may be layered into the wellbore 108 to begin installation of a cement plug positioned on the chemical plug 702.

Figure 10:
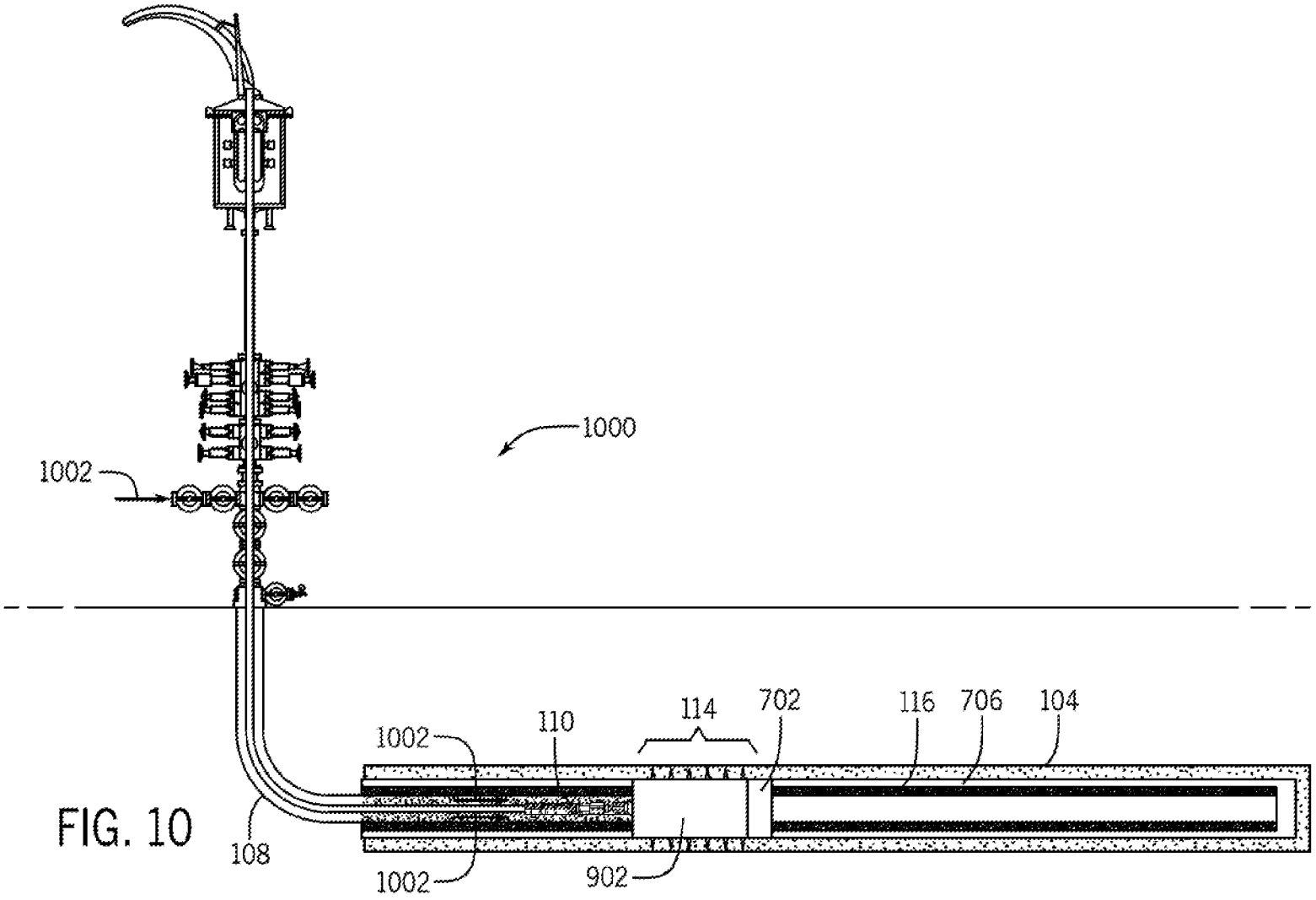
FIG. 10 is a cross-sectional view of the wellbore environment of FIG. 1 during a final portion of the cement layering stage according to some aspects of the present disclosure.

FIG. 10 is a cross-sectional view of a wellbore environment 1000 during a final portion of the cement layering stage. While the cement 902 is being layered within the wellbore 108, the downhole tool 110 may begin moving uphole within the wellbore 108. Additionally, backside pressure, as indicated by arrows 1002, may be maintained on the cement 902 to squeeze the cement 902 into the annulus 706 between the casing 116 and the formation 104. Squeezing the cement 902 into the annulus 706 may ensure sealing communication between the cement 902 and the formation 104. Layering the cement 902 in the wellbore 108 may involve gradually depositing the cement 902 at the target interval 114 while slowly withdrawing the downhole tool 110 toward the surface 106 of the wellbore 108. Layering the cement 902 provides an operator with the ability to control the placement of the cement plug within the wellbore 108.

Figure 11:
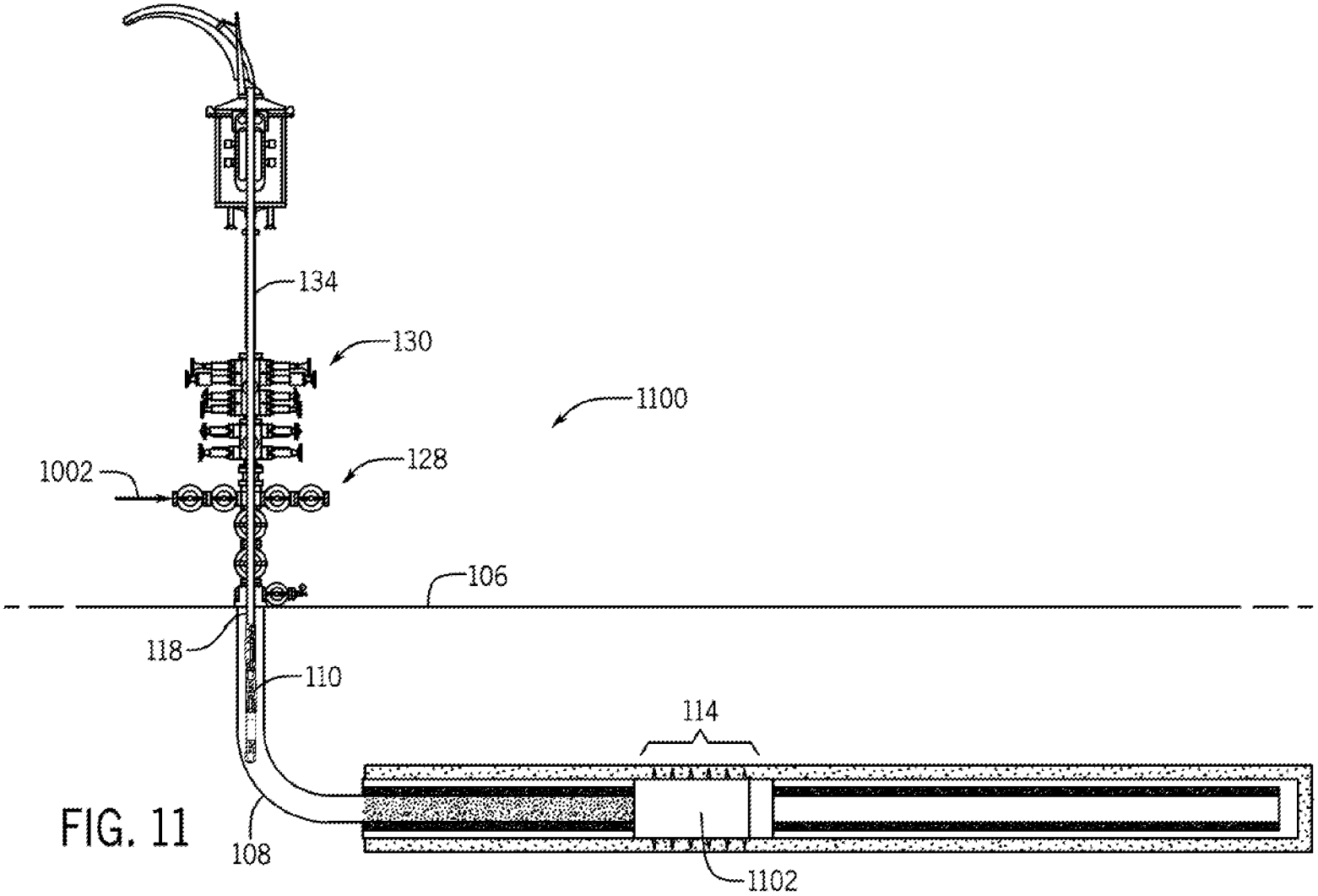
FIG. 11 is a cross-sectional view of the wellbore environment of FIG. 1 during a tool removal stage according to some aspects of the present disclosure.

FIG. 11 is a cross-sectional view of a wellbore environment 1100 during a tool removal stage. Upon completing installation of a cement plug 1102 at the target interval 114 within the wellbore 108, the downhole tool 110 may be flushed clean with water, brine, or a cleaning solution. Flushing the downhole tool 110 may be performed while squeezing pressure is maintained on the cement plug 1102, as indicated by the arrow 1002.

After the downhole tool 110 is flushed, the coiled tubing system 120 may lift the downhole tool 110 out of the wellbore 108 and into the lubricator 134. When the downhole tool 110 is positioned within the lubricator 134, a valve from the wellhead 128 into the wellbore 108 that allows the downhole tool 110 and the coiled tubing 118 to enter the wellbore 108 is closed. Further, pressure within the lubricator 134 is bled off until a pressure differential between the lubricator 134 and an outside environment of zero is verified. After verifying the zero pressure differential, a connection between the lubricator 134 and the blowout preventer 130 may be broken and the downhole tool 110 and any other equipment at the surface 106 may be rigged down.

Figure 12:
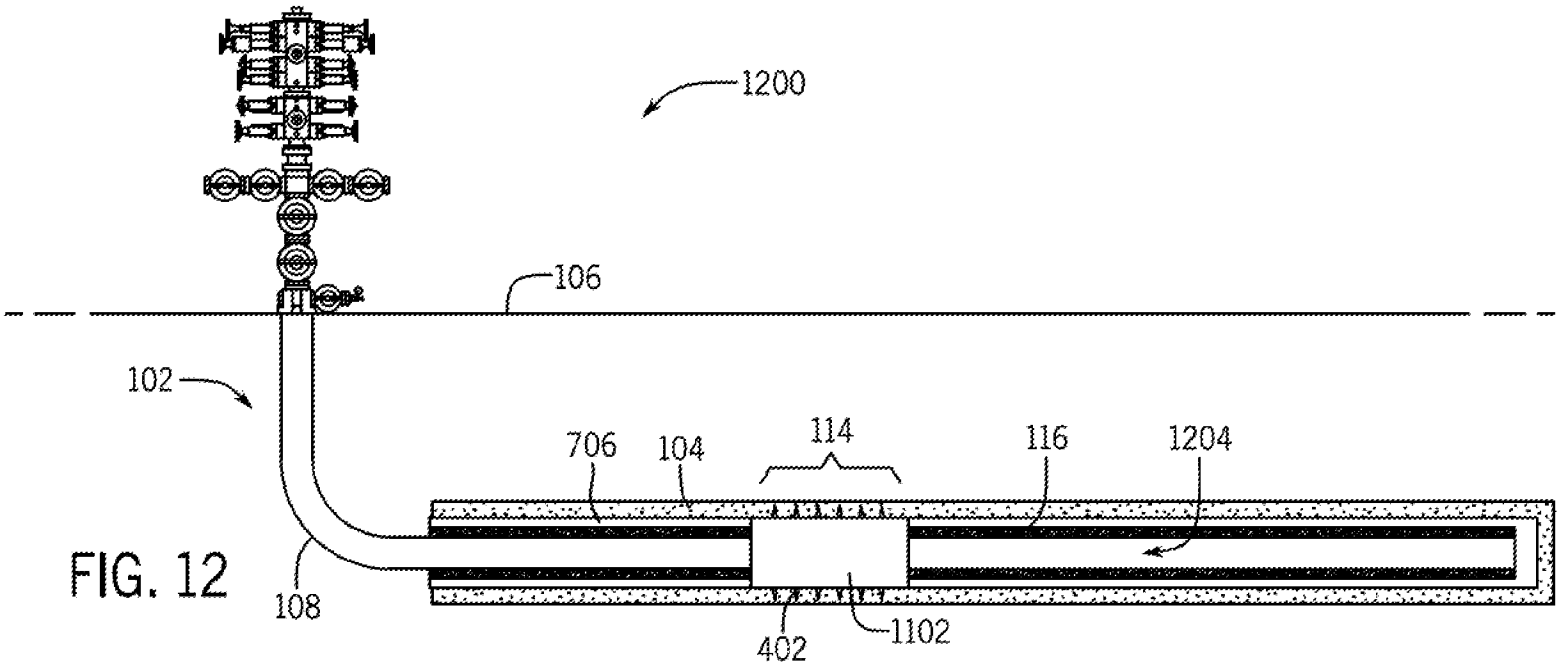
FIG. 12 is a cross-sectional view of the wellbore environment of FIG. 1 upon completion of installation of a cement plug according to some aspects of the present disclosure.

FIG. 12 is a cross-sectional view of a wellbore environment of 1200 upon completion of installation of the cement plug 1102. Over time the chemical plug 702 may degrade leaving only the cement plug 1102 positioned within the wellbore 108. The cement plug 1102 may provide sufficient isolation between downhole portions 1204 of the wellbore 108 and the surface 106 of the well 102 for the well 102 to be abandoned.

In an example where the cement plug 1102 is installed to remediate damage to the casing 116, the cement plug 1102 may be drilled through such that subsequent completion or production operations may be performed on the well 102. In another example, instead of generating the cement plug 1102 through layering, the downhole tool 110 may wipe the cement into the perforations 402 or the slots while the cement is layered into the wellbore 108. In another example, the cement may be squeezed or displaced into the formation 104 or the annulus 706 leaving an inner diameter of the casing 116 accessible (e.g., clear or filled with a spacer fluid or degradable, soluble, or otherwise easily removable filler). In such an example, the cementing process may result in a cement tube replacing damaged sections of the casing 116.

In any example, the downhole tool 110 may perform the operations associated with FIGS. 3-12 in a single run within the wellbore 108. That is, the downhole tool 110 may not be removed from the wellbore 108 during transitions between operational stages of the downhole tool 110. Further, the downhole tool 110 may perform the operations associated with FIGS. 3-12 on multiple target intervals within the wellbore 108. For example, each operation may be performed at a further downhole target interval and a further uphole target interval before moving to the next operation (e.g., when using a ball drop system). In another example, the downhole tool 110 may use reversible operation transitions (e.g., hydraulic transition mechanisms, piston transition mechanisms, a reversible ball drop system, etc.) that may enable each operation to be performed on the further downhole target interval before performing each operation on a further uphole target interval all in the same downhole run of the downhole tool 110.

In cases of slot recovery, a repaired section of the wellbore 108 may be sealed in a manner by which the cement is not left in the inner diameter of the wellbore 108, as descried above, or the remaining cement or sealant may be subsequently milled out to restore the inner diameter of the wellbore 108 through the repaired section. For wells where existing zones or natural production zones are planned for locations downhole from the sealed interval, no further remediation would be needed. For wells relying on additional treatments that may require high pressure operations (e.g., hydraulic fracturing), a casing patch (not shown) may be applied across the sealed interval to restore a more robust pressure integrity across the sealed interval. The casing patch may be a metal sleeve that is insertable within the wellbore 108 over the sealed interval. In one or more additional examples, the casing patch may be made from other materials that are compatible with fluids located within the wellbore 108.

Figure 13:
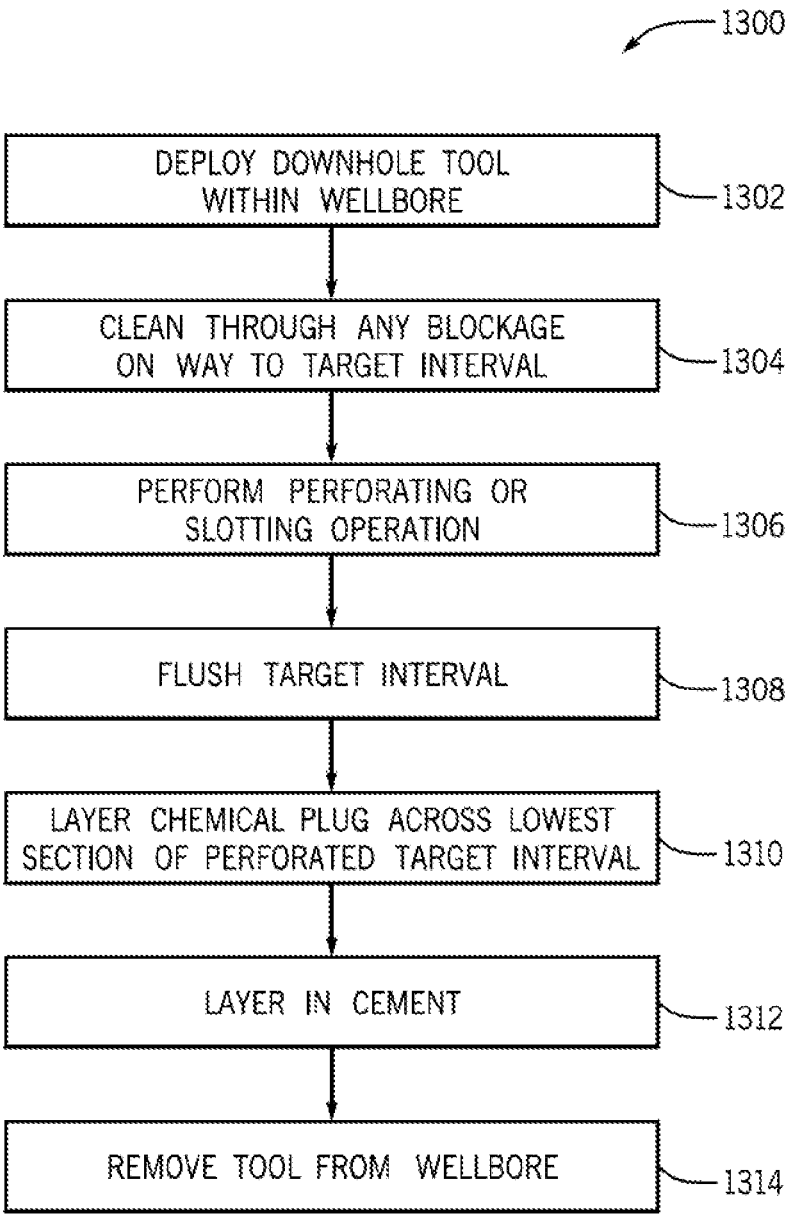
FIG. 13 is a flowchart of a process for operating the downhole tool of FIGS. 1-12 according to aspects of the present disclosure.

FIG. 13 is a flowchart of a process 1300 for operating the downhole tool 110. At block 1302, the process 1300 involves deploying the downhole tool 110 within the wellbore 108. As discussed above with respect to FIG. 1, the downhole tool 110 may be deployed within the wellbore 108 using the coiled tubing system 120, a jointed pipe system, or any other system capable of deploying the downhole tool 110 within the wellbore 108.

At block 1304, the process 1300 involves cleaning through any blockage while running the downhole tool 110 to the target interval 114. In an example, the downhole tool 110 includes a tapered bull nose 202 or other tool component with one or more fluid jets 206 positioned to jet fluid in a downhole direction. The fluid jets 206 may break up debris within the wellbore 108 and either circulate the debris 112 or other blockages in an uphole direction toward the surface 106 or circulate the debris 112 or other blockages to locations further downhole from the downhole tool 110.

At block 1306, the process 1300 involves performing a perforating or slotting operation at the target interval 114. The perforating or slotting tool 210 may generate the perforations or slots in the casing 116 to provide paths for sealing communication between the formation 104 and an inner area of the wellbore 108 where the cement plug 1102 will ultimately be positioned. That is, the perforations 402 or the slots provide zonal access of the cement plug to the formation 104. The perforations 402 or slots may be generated using an abrasive slurry, thermal or chemical cutting fluids, mechanical cutting mechanisms, explosive charges, an underreamer, or any other devices and materials able to cut perforations or slots in the casing 116.

At block 1308, the process 1300 involves flushing the target interval 114. The fluidic oscillator 212 may provide fluid oscillations at the target interval 114 to flush any debris or buildup from the target interval 114 after generating the perforations or slots. The fluid oscillations may use spotting acid, solvent, or another cleaning agent to flush the target interval 114. Further, the fluidic oscillator 212 may provide a conditioning treatment to the target interval 114 to prepare the wellbore 108 for the chemical plug and the cement plug placement.

At block 1310, the process 1300 involves layering the chemical plug 702 across a lowest section of the perforated target interval 114. The chemical plug 702 may enable temporary downhole isolation of an inner diameter 704 of the casing 116 and an annulus 706 surrounding the casing 116 (e.g., a layer of cement between the casing 116 and the formation 104). Further, the chemical plug 702 may be made from a chemical capable of hardening in several hours and maintaining its integrity for multiple days. After a set amount of exposure time or contact with a degrading chemical (e.g., HCl), the chemical plug 702 may degrade and liquefy. In an example, prior to degradation, the chemical plug 702 may provide a platform upon which the cement plug 1102 is installed. The chemical plug 702, or another mechanical plug, may also be placed downhole from the target interval 114 prior to the perforation process of the target interval.

At block 1312, the process 1300 involves layering in the cement 902 that makes up the cement plug 1102. The downhole tool 110 may provide the cement 902 to the target interval 114, and backpressure may be supplied in a downhole direction to push the cement 902 into the annulus 706 between the casing 116 and the formation 104. In an example, the cement 902 may make the cement plug 1102. In another example where the cement 902 is installed to remediate a damaged section of the wellbore 108, the downhole tool 110 may be equipped with a wiper that wipes the cement to create a cement tube along the target interval 114.

At block 1314, the process 1300 involves removing the downhole tool 110 from the wellbore 108. Removing the downhole tool 110 from the wellbore 108 may involve withdrawing the coiled tubing 118 and the downhole tool 110 in an uphole direction until the downhole tool 110 is positioned within the lubricator 134. When the downhole tool 110 is positioned within the lubricator 134, a valve connecting the lubricator 134 to the wellbore 108 may be closed and the pressure within the lubricator 134 bled off. When a pressure differential between the lubricator 134 and the outside environment reaches zero, the lubricator 134 may be detached from the blowout preventer 130 or the wellhead 128 such that the downhole tool 110 is accessible for rigging down.

While the process 1300 describes generation of an individual cement plug 1102 at an individual target interval 114, the downhole tool 110 may generate one or more additional cement plugs at one or more additional target intervals 114 without removing the downhole tool 110 from the wellbore 108. For example, the perforating or slotting operation of block 1306 may be performed at a further downhole target interval prior to being repeated at a further uphole target interval. After performing the perforating or slotting operation, the two target intervals may each be flushed at block 1308. Subsequently the further downhole target interval may perform the chemical plug layering of block 1310 and the cement layering of block 1312 before blocks 1310 and 1312 are repeated at the further uphole target interval. All of these blocks may be performed on both of the target intervals prior to removing the downhole tool 110 from the wellbore at block 1314. That is, both target intervals may receive a cement plug 1102 in a single run of the downhole tool 110 within the wellbore 108.

Embodiments of the methods disclosed in the process 1300 may be performed in the operation of the downhole tool 110. The order of the blocks presented in the process 1300 above can be varied—for example, blocks can be reordered, combined, removed, and/or broken into sub-blocks. Certain blocks or processes can also be performed in parallel.

In some aspects, systems, devices, and methods for installing a cement plug within a wellbore are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a method, comprising: deploying a downhole tool within a wellbore; and while the downhole tool is within the wellbore: slotting or perforating a casing of the wellbore at the target interval to expose formation surrounding the wellbore; flushing the target interval to remove wellbore debris from the target interval; and placing a cement or sealant plug at the target interval.

Example 2 is the method of example 1, further comprising, while the downhole tool is within the wellbore, placing a chemical plug at the target interval prior to placing the cement or sealant plug at the target interval.

Example 3 is the method of examples 1 to 2, further comprising, while the downhole tool is within the wellbore, jetting or circulating fluid through the downhole tool to clean debris or blockages while running the downhole tool to a target interval within the wellbore.

Example 4 is the method of examples 1 to 3, further comprising removing the downhole tool from the wellbore after layering the cement plug.

Example 5 is the method of example 4, wherein removing the downhole tool from the wellbore comprises: flushing the downhole tool to clean the downhole tool after placing the cement or sealant plug; withdrawing the downhole tool to a lubricator positioned at a surface of the wellbore; and bleeding off pressure in the lubricator prior to removing the downhole tool from the lubricator.

Example 6 is the method of examples 1 to 5, wherein deploying the downhole tool within the wellbore comprises deploying the downhole tool with a coiled tubing system.

Example 7 is the method of examples 1 to 6, wherein slotting or perforating the casing provides zonal access of the cement or sealant plug to the target interval.

Example 8 is the method of examples 1 to 7, wherein the downhole tool comprises a ball drop system, hydraulic transition mechanisms, piston transition mechanisms, or a reversible ball drop system to transition the downhole tool between tool elements.

Example 9 is the method of examples 1 to 8, further comprising: while the downhole tool is within the wellbore: slotting or perforating the casing of the wellbore at an additional target interval to expose the formation surrounding the wellbore; flushing the additional target interval to remove the wellbore debris from the additional target interval; and placing an additional cement or sealant plug at the additional target interval.

Example 10 is the method of examples 1 to 9, further comprising: restoring access through the cement plug to include an accessible inner diameter to enable subsequent production or treatment of the wellbore downhole from the cement plug.

Example 11 is a downhole tool, comprising: at least one fluid jet to clean debris or blockages within a wellbore while the downhole tool is within the wellbore; a perforating or slotting tool to perforate a casing within the wellbore along a target interval while the downhole tool is within the wellbore; a wash tool to flush the target interval while the downhole tool is within the wellbore; and a port to deposit a chemical plug and cement or sealant into the wellbore while the downhole tool is within the wellbore to generate a cement or sealant plug within the wellbore.

Example 12 is the downhole tool of example 11, wherein the perforating or slotting tool comprises a hydraulic jet positionable to transmit an abrasive slurry into the casing to generate a perforation or a slot in the casing, and wherein the abrasive slurry comprises abrasive particles or soluble or degradable abrasive material.

Example 13 is the downhole tool of examples 11 to 12, wherein the wash tool comprises a fluidic oscillator that flushes the target interval with a spotting acid, a solvent, or a cleaning agent to remove debris from the target interval.

Example 14 is the downhole tool of examples 11 to 13, wherein the port comprises a burst disc tool to burst when pressure within the downhole tool exceeds a pressure threshold.

Example 15 is the downhole tool of examples 11 to 14, comprising a ball drop system, a hydraulic transition mechanism, a piston transition mechanism, or a reversible ball drop system to transition operation of the downhole tool between tool elements of the downhole tool while the downhole tool is within the wellbore.

Example 16 is the downhole tool of examples 11 to 15, wherein the perforating or slotting tool comprises an expandable blade, a tubing punch, an expandable underreamer, a chemical or thermal cutter, or an explosive perforating gun.

Example 17 is a system, comprising: a downhole tool to install a cement plug or sealant within a wellbore, the downhole tool comprising: at least one fluid jet to clean debris blockages within the wellbore; a perforating or slotting tool to perforate a casing within the wellbore along a target interval; a wash tool to flush the target interval; and a port to deposit a chemical plug and cement or sealant into the wellbore to generate the cement or sealant plug within the wellbore; and a tool conveyance system coupleable to the downhole tool to deliver the downhole tool into the wellbore and to deliver fluid to the downhole tool at a downhole location within the wellbore.

Example 18 is the system of example 17, wherein the downhole tool is operable to install the cement or sealant plug within the wellbore in a single downhole run within the wellbore.

Example 19 is the system of examples 17 to 18, wherein the downhole tool is operable to install two cement or sealant plugs within the wellbore in a single downhole run within the wellbore.

Example 20 is the system of examples 17 to 19, comprising a ball drop system to transition operation of the downhole tool between the at least one fluid jet, the perforating or slotting tool, the wash tool, and the port.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A method, comprising:

deploying a downhole tool within a wellbore; and while the downhole tool is within the wellbore:

jetting or circulating fluid through the downhole tool in a downhole direction to clean debris or blockages within a casing of the wellbore while running the downhole tool to a target interval within the wellbore;

slotting or perforating the casing of the wellbore at the target interval to expose formation surrounding the wellbore;

flushing the target interval to remove wellbore debris from the target interval; and placing a cement plug or a sealant plug at the target interval.

2. The method of claim 1, further comprising, while the downhole tool is within the wellbore, placing a chemical plug at the target interval prior to placing the cement or sealant plug at the target interval.

3. The method of claim 1, further comprising removing the downhole tool from the wellbore after placing the cement plug.

4. The method of claim 3, wherein removing the downhole tool from the wellbore comprises:

flushing the downhole tool to clean the downhole tool after placing the cement or sealant plug;

withdrawing the downhole tool to a lubricator positioned at a surface of the wellbore; and bleeding off pressure in the lubricator prior to removing the downhole tool from the lubricator.

5. The method of claim 1, wherein deploying the downhole tool within the wellbore comprises deploying the downhole tool with a coiled tubing system.

6. The method of claim 1, wherein the downhole tool comprises a ball drop system, hydraulic transition mechanisms, piston transition mechanisms, or a reversible ball drop system to transition the downhole tool between tool elements.

7. The method of claim 1, further comprising:

while the downhole tool is within the wellbore:

slotting or perforating the casing of the wellbore at an additional target interval to expose the formation surrounding the wellbore;

flushing the additional target interval to remove wellbore debris from the additional target interval; and placing an additional cement or sealant plug at the additional target interval.

8. The method of claim 1, further comprising:

restoring access through the cement plug to include an accessible inner diameter to enable subsequent production or treatment of the wellbore downhole from the cement plug.

9. A downhole tool, comprising:

at least one fluid jet configured to clean debris or blockages within a wellbore while the downhole tool is within the wellbore by jetting or circulating fluid in a downhole direction;

a perforating or slotting tool configured to perforate a casing within the wellbore along a target interval while the downhole tool is within the wellbore;

a wash tool configured to flush the target interval while the downhole tool is within the wellbore, the wash tool being separate from the at least one fluid jet and being configured to flush the target interval by jetting fluid radially outwardly from the downhole tool toward a wall of the wellbore; and a port configured to allow deposit of a chemical plug and cement or sealant into the wellbore while the downhole tool is within the wellbore to generate a cement or sealant plug within the wellbore.

10. The downhole tool of claim 9, wherein the perforating or slotting tool comprises a hydraulic jet configured to transmit an abrasive slurry into the casing to generate a perforation or a slot in the casing.

11. The downhole tool of claim 9, wherein the wash tool comprises a fluidic oscillator configured to flush the target interval with a spotting acid, a solvent, or a cleaning agent to remove debris from the target interval by providing the spotting acid, the solvent, or the cleaning agent with pulsating resonance as a cyclic output.

12. The downhole tool of claim 9, wherein the port comprises a burst disc tool configured to burst when pressure within the downhole tool exceeds a pressure threshold.

13. The downhole tool of claim 9, further comprising a ball drop system, a hydraulic transition mechanism, a piston transition mechanism, or a reversible ball drop system configured to transition operation of the downhole tool between tool elements of the downhole tool while the downhole tool is within the wellbore.

14. The downhole tool of claim 9, wherein the perforating or slotting tool comprises an expandable blade, a tubing punch, an expandable underreamer, a chemical or thermal cutter, or an explosive perforating gun.

15. A system, comprising:

a downhole tool configured to install a cement plug or sealant within a wellbore, the downhole tool comprising:

at least one fluid jet configured to clean debris blockages within the wellbore by jetting or circulating fluid in a downhole direction;

a perforating or slotting tool configured to perforate a casing within the wellbore along a target interval;

a wash tool configured to flush the target interval, the wash tool being separate from the at least one fluid jet and being configured to flush the target interval by jetting fluid radially outwardly from the downhole tool toward a wall of the wellbore; and a port movable between open and closed positions to allow deposit of a chemical plug and cement or sealant into the wellbore to generate the cement or sealant plug within the wellbore; and a tool conveyance system coupleable to the downhole tool to deliver the downhole tool into the wellbore and configured to deliver fluid to the downhole tool at a downhole location within the wellbore.

16. The system of claim 15, wherein the downhole tool is operable to install the cement or sealant plug within the wellbore in a single downhole run within the wellbore.

17. The system of claim 15, wherein the downhole tool is operable to install two cement or sealant plugs within the wellbore in a single downhole run within the wellbore.

18. The system of claim 15, further comprising a ball drop system configured to transition operation of the downhole tool between the at least one fluid jet, the perforating or slotting tool, the wash tool, and the port.

19. The system of claim 15, wherein the wash tool comprises a fluidic oscillator configured to flush the target interval with a spotting acid, a solvent, or a cleaning agent to remove debris from the target interval by providing the spotting acid, the solvent, or the cleaning agent with pulsating resonance as a cyclic output.

20. The system of claim 19, wherein the fluidic oscillator is configured to deposit a conditioning treatment to the target interval to prepare the target interval for the chemical plug and cement or sealant.

* * * * *